US009421138B1

(12) United States Patent
Slater

(10) Patent No.: US 9,421,138 B1
(45) Date of Patent: Aug. 23, 2016

(54) SELF-PROPELLING STANDING COMMODE WHEELCHAIR

(71) Applicant: Neil Slater, Renton, WA (US)

(72) Inventor: Neil Slater, Renton, WA (US)

( * ) Notice: Subject to any disclaimer, the term of this patent is extended or adjusted under 35 U.S.C. 154(b) by 0 days.

(21) Appl. No.: 14/513,937

(22) Filed: Oct. 14, 2014

(51) Int. Cl.
*A61G 5/10* (2006.01)
*A61G 5/02* (2006.01)

(52) U.S. Cl.
CPC ..... *A61G 5/1002* (2013.01); *A61G 5/02* (2013.01)

(58) Field of Classification Search
CPC ..... A61G 5/02; A61G 5/1002
USPC ..... 280/200, 250.1, 288.4, 304.1, 648
See application file for complete search history.

(56) References Cited

U.S. PATENT DOCUMENTS 4,067,249 A * 1/1978 Deucher ..... 297/330
5,346,280 A * 9/1994 Deumite ..... 297/330
5,984,338 A * 11/1999 Meyer ..... 280/304.1
6,176,508 B1 * 1/2001 Malassigne et al. ..... 280/648
6,851,751 B1 2/2005 Romero et al.
2005/0236812 A1 10/2005 Firth
2008/0265548 A1 * 10/2008 Hammer et al. ..... 280/650
2010/0219668 A1 * 9/2010 Nelson et al. ..... 297/330

* cited by examiner

*Primary Examiner* — Joseph Rocca
*Assistant Examiner* — Felicia L Brittman
(74) *Attorney, Agent, or Firm* — Daniel Boudwin; Global Intellectual Property Agency, LLC

(57) ABSTRACT

The present invention provides a self-propelling standing commode wheelchair that can be positioned over a standard toilet seat. The present invention includes a wheeled frame, and an inverted U-shaped seat pivotally mounted thereon. The wheeled frame includes a pair of armrests, which is attached to a pair of gas struts that allows the present invention to be erected into a standing configuration. The present invention also includes a plurality of footrests and straps to stabilize the user in an upright position. The present invention further includes stabilizers, wherein the stabilizers are attached to the armrests, and are adapted to contact the ground when the present invention erects into the standing configuration. The stabilizers are configured to prevent the present invention from tipping over, and can be elevated above the ground when the present invention is lowered into a sitting configuration.

15 Claims, 4 Drawing Sheets

SELF-PROPELLING STANDING COMMODE WHEELCHAIR

CROSS REFERENCE TO RELATED APPLICATION

This application claims the benefit of U.S. Provisional Application No. 61/890,480 filed on Oct. 14, 2013. The above identified patent application is herein incorporated by reference in its entirety to provide continuity of disclosure.

BACKGROUND OF THE INVENTION

1. Field of the Invention

The present invention relates to wheelchairs and commode chairs. More specifically, the present invention pertains to an improved standing commode wheelchair that uses a pair of gas struts to erect the wheelchair into a standing configuration and lower it into a sitting configuration. In addition, the present invention comprises a seat that is configured for over-the-toilet use.

Standing wheelchairs allows a wheelchair user to raise the chair from a seated to a standing configuration. The standing wheelchair supports the person in a standing position and enables interaction with people and object at an eye level. There are many physical benefits to a standing wheelchair. One such benefit is for urinary health as urinary tract infections are common among people confined to wheelchairs. Standing, even while assisted by a standing wheelchair can greatly decrease urinary tract infections by promoting better urinary drainage. Another benefit is for circulation. Changing postures help the blood circulate, as sitting in one position for too long causes the blood to stagnate and reduce circulation. In addition, sitting for too long can also cause muscle spasticity. Changing positions can also help relax the muscles and reduce spasticity.

There are also psychological benefits of standing wheelchairs. One of the biggest benefits is from the increased independence and productivity. A user may reach higher shelves and cupboards at home, or look into a mirror at eye level. Another psychological benefit is due to self-perception. Standing and speaking to others directly at eye level allows the user to feel equal with others both in stature and in status.

However, the existing types of standing wheelchairs cannot fit over standard toilet bowls for over-the-toilet use. Such wheelchairs often have heavy bases or electric motors that limit the mobility of wheelchairs. The present invention provides a standing self-propelling wheelchair with the benefit of being able to wheel over a standard toilet bowl for bathroom use. The present invention includes a wheeled frame with two side frames, and a seat and a backrest pivotably mounted to the wheeled frame. A plurality of gas struts are attached to the wheel frame and armrests, which allow the present invention to be easily raised into the standing configuration without requiring assistance from others. The present invention also includes a plurality of footrests, lower body straps, and upper body straps to stabilize the user in the upright position. Further, the armrests include stabilizers, which contact the ground when the present invention is in the standing configuration. The stabilizers are positioned so that the present invention will not tip in the standing configuration. Thereafter, the stabilizers lift off of the ground when the present invention is lowered into a sitting configuration. In addition, the seat comprises a generally inverted U-shape to substantially match the shape of a toilet seat. Thus, the present invention is adapted to wheel over a standard toilet bowl for over-the-toilet use.

2. Description of the Prior Art

Devices have been disclosed in the prior art that relate to wheelchairs and stand-up wheelchairs. These include devices that have been patented and published in patent application publications. Some of these devices disclose a motor that erect the seat panels into a standing position. Other devices disclose wheelchairs that provide an elevated seating position or a partially standing position. These devices, however, do not disclose a self-propelling wheelchair that uses gas struts mounted to the seat to erect it into a standing a configuration and that can wheel over standard toilet bowls for over-the-toilet use. The foregoing is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 5,984,338 to Meyer discloses a raising-type wheelchair that has a customary wheeled frame with a pair of front wheels and a pair of rear wheels. A raising system includes a seat and a backrest. The wheelchair also has a footrest and a foot support surface. The wheeled frame is a tubular construction formed by two side frames coupled together by cross-rods. Raising of the chair from the sitting position is supported in part by at least one gas spring. The backrest is approximately in the same vertical position regardless of the position of the seat, or whether the wheelchair is in a sitting or standing configuration. The Meyer device, however, does not disclose a seat with a substantially inverted U-shape or a pair of stabilizers that prevent the wheelchair from tipping over while in the standing configuration.

Similarly, U.S. Pat. No. 4,067,249 to Deucher discloses a foldable raising wheelchair which includes a support frame, a seat surface, a foot rest, and a seat backrest, and a mechanism to raise and lower the seat. The support frame includes two side frames connected by struts. The struts have a pivot in the middle, allowing both side frames to collapse and lie adjacent to each other. A seat surface and backrest are secured to the frame. The mechanism for erecting and lowering the seat comprises at least one gear segment, a drive pinion, and an electrical motor. A user operates a switch, which puts the electric motor in motion and the drive pinion runs counter-clockwise and drives the gear segment clockwise to erect the wheelchair. The gear segment rotates counter-clockwise to return the chair into a sitting position. The Deucher device, however, does not disclose a substantially inverted U-shape seat and gas struts that erect the wheelchair into a standing configuration.

U.S. Pat. No. 6,851,751 to Romero discloses a wheelchair for assisting a person seated in the wheelchair to move to a standing position and return to a sitting position. The Romero device is an apparatus comprising a seat portion hinged to a back portion, at least one lift bar pivotally attached to the underside of the seat, and at least one foot actuated member having a first end attached to the lift bar, whereby raising the lift bar moves the seat portion into a substantially upright position. The Romero device, however, does not disclose a device that erects into a fully standing configuration or a seat with a substantially inverted U-shape.

U.S. Published Patent Number 2005/0236812 to Firth discloses a wheelchair with an elevating seat, wherein the seat is connected to a frame. The seat can be elevated to a 45 degree angle above the standard sitting angle via a translating mechanism. The translating mechanism comprises a first end and a second end, wherein the first end is attached to the frame of the wheelchair, and the second end is attached to the seat. In one embodiment, the wheelchair may further comprise gas struts to raise the seat. The Firth device, however, is limited in that it only discloses a device for elevated seating, and not a device that allows for standing and over-the-toilet use.

Finally, U.S. Pat. No. 5,346,280 to Deumite is directed to a wheelchair with an automatic standing aid, which can lift the operator into a standing position while the operator remains supported. The Deumite device discloses a stand-up wheelchair with a mobile power base, a main frame mounted to the mobile power base, a framework pivotally mounted to the main frame to move the occupant into a standing position, a seat, and seatback panel. The Deumite device also discloses a drive means for automatically raising and lowering the framework, wherein the drive means is powered by a motor. The device further comprises at least one stabilizer with a wheel at an end thereof. In contrast, the present invention comprises a gas struts for raising and lowering the wheelchair frame work. Additionally, the present invention comprises a self-propelled wheelchair.

The devices disclosed in the prior art have several known drawbacks. Some of these devices disclose a motor that erect the seat panels into a standing position. Other devices disclose wheelchairs that provide an elevated seating position or a partially standing position. The present invention overcomes these limitations by disclosing a self-propelling wheelchair that uses gas struts attached to the wheeled frame to erect the seat into a standing configuration. Additionally, the present invention comprises stabilizers to prevent the wheelchair from tipping over. In addition, the present invention is adapted to wheel over a standard toilet bowl for over-the-toilet use. It is therefore submitted that the present invention is substantially divergent in design elements from the prior art, and consequently it is clear that there is a need in the art for an improvement to self-propelling wheelchairs and specifically, self-propelling stand-up wheelchairs. In this regard, the instant invention substantially fulfills these needs.

SUMMARY OF THE INVENTION

In view of the foregoing disadvantages inherent in the known types of standing wheelchairs now present in the prior art, the present invention provides a new and improved self-propelling standing commode wheelchair that is used to assist wheelchair users to raise the chair from a seated to a standing configuration in a safe manner.

It is therefore an object of the invention to provide a new and improved self-propelling standing commode wheelchair that has all of the advantages of the prior art and none of the disadvantages.

Another object of the present invention is to provide a new and improved self-propelling standing commode wheelchair that provides a plurality of gas struts attached to the wheeled frame to erect the seat into a standing configuration.

Still yet another object of the present invention is to provide a new and improved self-propelling standing commode wheelchair that provides a plurality of stabilizers to prevent the present invention from tipping over while erected in the standing configuration.

Another object of the present invention is to provide a new and improved self-propelling standing commode wheelchair that provides a seat that can be positioned over a conventional toilet seat to allow the user to use the toilet seat in a usual manner.

Another object of the present invention is to provide a new and improved self-propelling standing commode wheelchair that allows the user to operate the wheelchair independently.

A further object of the present invention is to provide a new and improved self-propelling standing commode wheelchair that provides a strap to support the user when standing in an upright position.

Still yet another object of the present invention is to provide a new and improved self-propelling standing commode wheelchair wherein the device may be readily fabricated from materials that permit relative economy and are commensurate with durability.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein the numeral annotations are provided throughout.

DETAILED DESCRIPTION OF THE INVENTION

Figure 1:
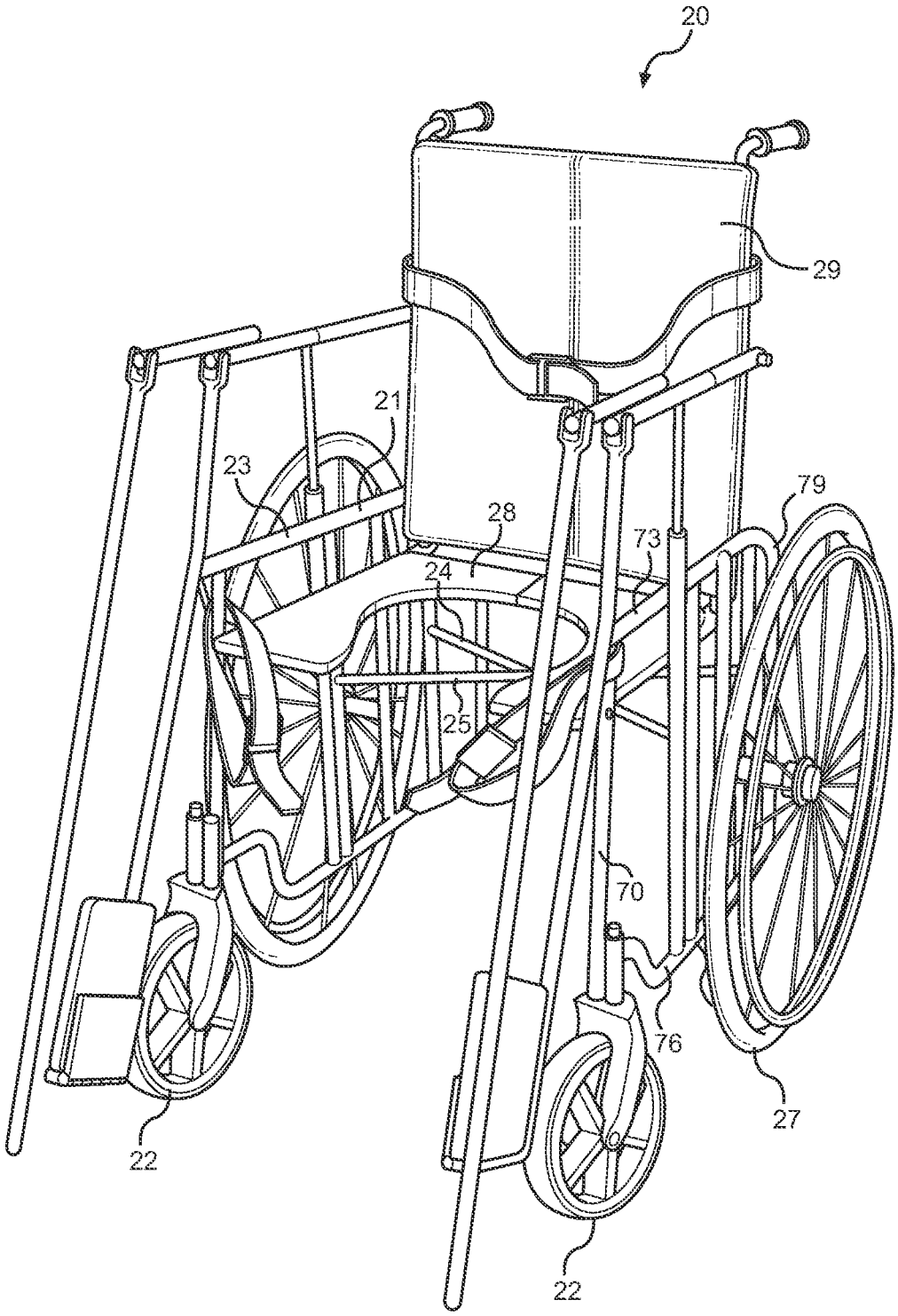
FIG. 1 shows a perspective view of the present invention in a sitting configuration.

References are made herein to the attached drawings. Like reference numerals are used throughout the drawings to depict like or similar elements of the self-propelling standing commode wheelchair. For the purposes of presenting a brief and clear description of the present invention, the preferred embodiment will be discussed as used to assist a wheelchair user when moving from a sitting position into a standing position and vice versa. The figures are intended for representative purposes only and should not be considered to be limiting in any respect.

Referring now to FIG. 1, there is shown a perspective view of the preferred embodiment of the present invention. As the wheelchair 20 is symmetrical along a vertical plane, elements discussed in the next few sections will have respective left and right identical parts. The wheelchair 20 has a conventional wheeled frame 21 comprising of two side frames 23 and a pair of front wheels 22, and a pair of rear wheels 27. The tubular construction of the wheelchair 20, including the side frames 23, are composed of a corrosion-resistant aluminum, stainless steel, carbon fiber, or the like.

Figure 4:
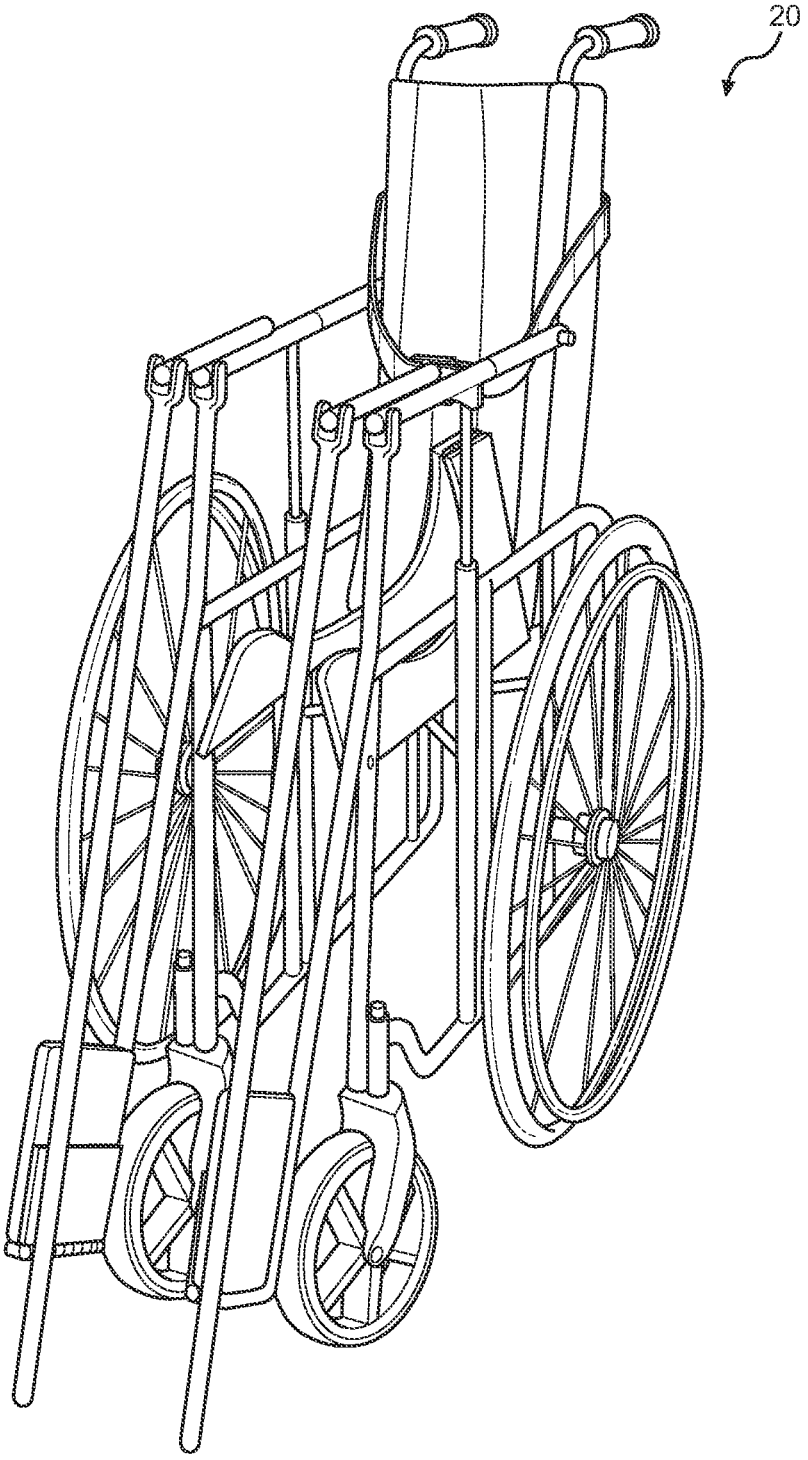
FIG. 4 shows a perspective view of the present invention in a collapsed configuration.

The side frames 23 are substantially rectangular in shape, and each side frame 23 comprises a top side 73 opposite a bottom side 76, and a front edge 70 opposite a rear edge 79. The front wheels 22 are mounted to the front edges 70 of the side frames 23, and the rear wheels 27 are mounted on the rear edges 79 of the side frames 23. The front wheels 22 are guidable or steerable wheels, as opposed to the rear wheels 27, which are used to propel and maneuver the wheelchair 20. In this way, the front wheels 22 can pivot with respect to the front edges 70 of the side frames 23. The side frames 23 are coupled together by a first and a second crossing rod 24, 25. The crossing rods 24, 25 are pivotally connected to each other so that it forms an X-shape when viewed from the top. Preferably, the rods 24, 25 are connected via a fastener that permits the rods 24, 25 to pivot with respect to one another so that the wheelchair 20 can be folded into a collapsed configuration, as shown in FIG. 4, and extended into an operating configuration, as shown in FIG. 1.

The wheelchair 20 further comprises a seat 28 having a first section and a second section, each of the first and second sections comprising a substantially L-shape, such that the two sections form a generally inverted U-shape when viewed from the top. The two sections are hingedly connected together so that the back portion of the seat 28 is connected and the front portion of the seat 28 is disconnected. The back portion of the seat 28 is pivotally attached to the backrest 29, and the front portion of the seat 28 is pivotally secured to the front edge 70 of the side frame 23. The seat 28 is substantially parallel with the horizontal axis and perpendicular to the backrest 29 when in a sitting configuration. Accordingly, the backrest 29 is substantially parallel with the vertical axis.

The seat 28 is substantially inverted U-shaped to reflect the shape of a standard toilet seat. In this way, the wheelchair 20 is adapted to be wheeled over a standard toilet bowl so that the seat 28 is positioned directly above the toilet seat. Accordingly, the wheelchair 20 is configured so that the seat 28 is positioned at an elevation greater than a standard toilet seat, and the distance between the opposing side frames 23 is greater than the width of a conventional toilet. Further, the crossing rods 24, 25 are biased toward the front of wheelchair 20 so that the back of the wheelchair 20 can be moved toward the back of the toilet. Thereafter, the user can utilize the toilet in a usual manner while sitting in the seat 28 of the wheelchair 20. It is contemplated that the seat 28 may be composed of a durable fabric, such as vinyl, or other suitable materials. Additionally, the seat 28 may be padded with foam or other suitable materials.

Figure 2:
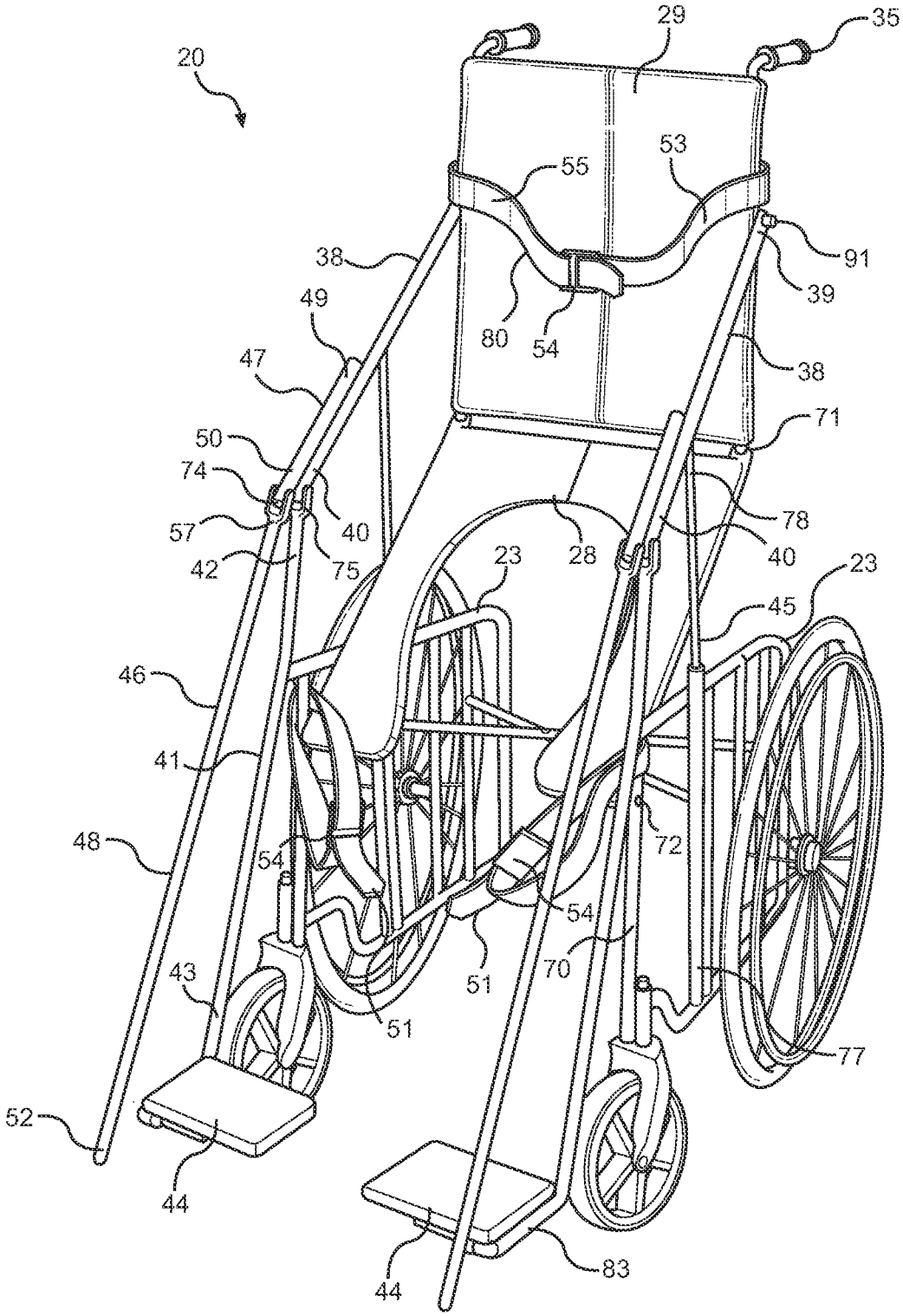
FIG. 2 shows a perspective view of the present invention erected into a standing configuration.
Figure 3:
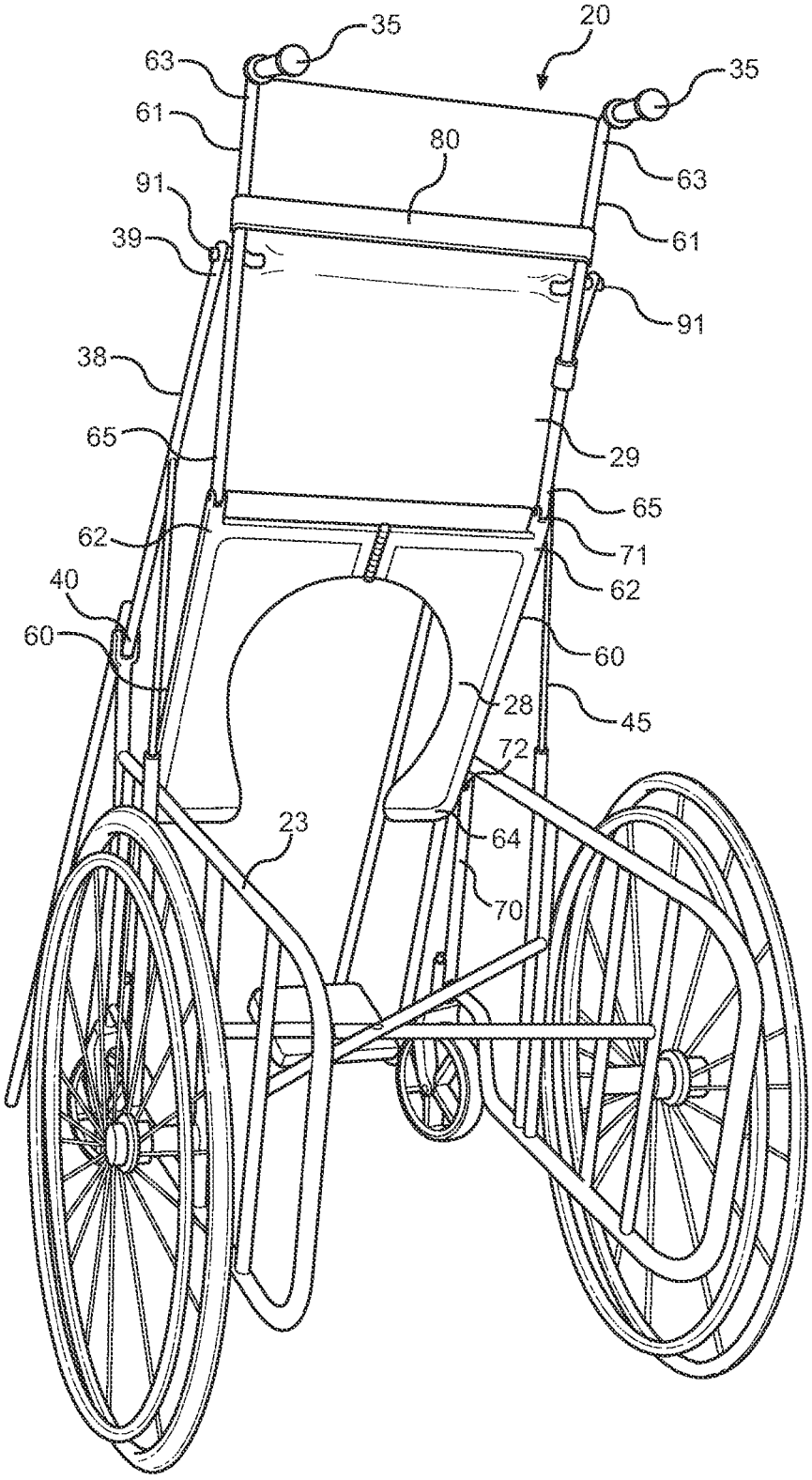
FIG. 3 shows a reverse view of the present invention erected into a standing configuration.

Referring now to FIGS. 2 and 3, there are shown perspective and reverse views of the wheelchair 20 in a standing configuration. Each of the seat 28 and the backrest 29 comprises a pair of tubular elements 60, 61 on opposing edges thereof, respectively. Each tubular elements 60, 61 comprises a first end 62, 63, and a second end 64, 65, respectively. The first ends 63 of the backrest tubular element 61 comprises handles 35 thereon. The handles 35 may be substantially perpendicular to the backrest tubular element 61. Additionally, the handles 35 may comprise a padded gripping portion thereon.

The first ends 62 of the seat tubular elements 60 are pivotally secured to the second ends 65 of the backrest tubular elements 61 via a fastener 71. It is contemplated that the second ends 65 of the backrest tubular elements 61 are knuckle joints. In addition, the second ends 64 of the seat tubular elements 60 are pivotally secured to the front edges 70 of the side frames 23 via a fastener 72. It is contemplated that the fasteners 71, 72 may comprise piano hinges, butt hinges, or continuous hinges, among others. The fasteners 71, 72 are adapted to allow the seat 28 and the backrest 29 to move from a sitting position to a standing position, and vice versa. As the wheelchair 20 is erected into the standing configuration, the seat 28 reaches a substantially upright position. In some embodiments, the wheelchair 20 further comprises a tab, on the lower rear corner, which can be actuated by a third party to raise the wheels off of the ground.

The wheelchair 20 further comprises a pair of armrests 38. Each of the armrests 38 comprises a first end 39 and a second end 40. The first ends 39 of the armrests 38 are pivotally attached to the backrest tubular element 61 at the substantial midpoint thereof. The armrests 38 may be attached to the backrest tubular element 61 via a fastener 91 or a mechanical joint. When the wheelchair 20 is in the sitting configuration, the armrests 38 are perpendicular to the backrest 29, or parallel with the horizontal axis. As wheelchair 20 is erected into the standing configuration, the fasteners 91 are adapted to allow the armrests 38 to pivot so that they move from a horizontal position to a substantially upright position. The second ends 40 of the armrests 38 are pivotally attached to a pair of footrest supports 41 via a fastener 75.

Each of the footrest supports 41 is an elongated rod having a first end 42 and second end 43, wherein the second end 43 comprises a bent portion 83 so that it is substantially L-shaped when viewed from the side. The footrest support 41 is welded to the side frame 23 so that it is unitary in structure. Preferably, the footrest support 41 is bent along the length thereof so that it is biased toward the front of the wheelchair 20. In this way, the footrest support 41 does not interfere with the usage of the front wheels. The first end 42 comprises a knuckle joint, and is pivotally attached to the second end 40 of armrests 38. The bent portion 83 of the second end 43 is hingedly attached to a foot panel 44. The foot panel 44 is substantially rectangular in shape and is adapted to extend inward such that it is perpendicular to the footrest support 41 in order to allow for a user to rest his or her feet on the foot panel 44. When not in use, the foot panel 44 can be folded upward so that it rests flush against the footrest support 41 and remains secured thereto. In some embodiments, the foot panel 44 may comprise a high friction surface or treading thereon so as to prevent the user's feet from slipping.

The armrests 38 may further comprise a pair of stabilizers 46 attached thereto, wherein the stabilizers 46 help distribute the weight of the wheelchair 20 in the standing configuration, thereby preventing the wheelchair 20 from tipping over in any direction. Each stabilizer 46 comprises a supporting arm 47 and a supporting leg 48 pivotally attached thereto. Each of the supporting arm 47 and the supporting leg 48 comprises a first end 49, 57 and a second end 50, 52. The entire length of the supporting arm 47 is attached near the second end 40 of the armrest 38. The second end 50 of the supporting arm 47 is pivotally attached to the first end 57 of supporting legs 48 via a fastener 74. The second end 52 of the supporting leg 48 is elevated above the ground in a sitting configuration. In this way, the wheelchair 20 can be easily wheeled. In the standing configuration, however, the supporting leg 48 is adapted to extend downward so that the second end 52 directly contacts the ground. Additionally, the supporting leg 48 may be substantially collinear with the supporting arm 47 when the wheelchair 20 is fully extended into the standing configuration.

The wheelchair 20 further comprises a pair of gas struts 45. Each of the gas struts comprises a cylindrical housing having a closed lower end 77, an open upper end, and an interior volume therein for holding a piston rod therein. The lower end 77 of the cylindrical housing is attached to the side frame 23. In some embodiments, the cylindrical housing may be welded to the side frame 23. The piston rod comprises a distal end 78 that is pivotally attached to the armrest 38 at the substantial midpoint thereof. The gas struts 45 utilize a compressed gas, contained in the cylindrical housing and compressed by the piston rod, to exert a force. In this way, the gas struts allow the user to easily move the wheelchair 20 from a sitting position to a standing position without requiring assistance from others.

In some embodiments, the present invention may further comprise control elements to move the wheelchair 20 from a sitting position to a standing position, and vice versa. It is contemplated that the control elements may comprise a lever, a button, or a dial for adjusting the gas struts, whereby releasing compressed gas within the cylindrical housing can move the wheelchair 20 into a sitting position, and adding gas can force the wheelchair 20 into a standing position.

The wheelchair 20 further comprises a pair of knee straps 51 and a chest strap 80. The straps 52, 80 are adapted to secure the user onto the wheelchair 20 while in the standing configuration. The chest strap 80 comprises a first section 53 and a second section 55 that can be engaged together via a buckle 54 or a similar fastener, and adjusted in length. One end of each of the first section 53 and the second section 55 may be stitched to the backrest 29. Each of the knee straps 51 comprises an elongated strap having two terminal ends that can be secured together via a buckle 54 or another suitable fastener, and adjusted in length. The knee straps 51 may be looped around the front edge of the side frames 23, then fastened to form a closed loop. In another embodiment, the knee straps 51 may be stitched to the seat 28.

Referring now to FIG. 4, there is shown a view of the present invention in a collapsed configuration. In the collapsed configuration, the side frames are brought towards each other. As the side frames are brought together, the seat is folded upward and the crossing rods pivot with respect to each other. Additionally, the backrest 29 is folded so that the backrest tubular elements are pressed closer together.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above descriptions then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A self-propelling standing commode wheelchair, comprising:

a wheeled frame having a pair of side frames;

said pair of side frames having a top side, a bottom side, a front edge, a rear edge;

a pair of front wheels attached to said front edge;

a pair of rear wheels attached to said rear edge;

a seat having a front portion and a back portion;

said front portion of said seat pivotally attached to said front edge of said pair of side frames;

a pair of crossing rods connected to said pair of side frames;

wherein said pair of crossing rods is adapted to pivot and collapse when in a collapsed configuration;

a backrest pivotally attached to said back portion of said seat;

wherein said backrest is perpendicular to said seat in a sitting configuration;

wherein said seat is substantially upright in a standing configuration.

2. The self-propelling standing commode wheelchair of claim 1, wherein said seat comprises a first section that is hingedly attached to a second section.

3. The self-propelling standing commode wheelchair of claim 1, wherein said seat comprises a generally inverted U-shape.

4. The self-propelling standing commode wheelchair of claim 1, wherein said seat further comprises a pair of seat tubular members on opposing sides thereof.

5. The self-propelling standing commode wheelchair of claim 4, wherein said backrest further comprises a pair of backrest tubular members on opposing sides thereof.

6. The self-propelling standing commode wheelchair of claim 5, wherein said pair of seat tubular members is pivotally attached to said pair of backrest tubular members.

7. The self-propelling standing commode wheelchair of claim 5; wherein said pair of backrest tubular elements further comprises handles.

8. The self-propelling standing commode wheelchair of claim 1, further comprising a pair of armrests pivotally attached to said backrest.

9. The self-propelling standing commode wheelchair of claim 8, further comprising a pair of footrest supports;

said pair of footrest supports pivotally attached to said pair of armrests;

each of said pair of supports having a foot panel hingedly attached thereto.

10. The self-propelling standing commode wheelchair of claim 8, further comprising a pair of stabilizers attached to said pair of armrests;

wherein said stabilizers directly contact the ground in said standing configuration and said stabilizers are elevated above the ground in said sitting configuration.

11. The self-propelling standing commode wheelchair of claim 10, each of said pair of stabilizers having a supporting arm pivotally attached to a supporting leg;

said supporting arm attached to said pair of armrests.

12. The self-propelling standing commode wheelchair of claim 8, further comprising a pair of gas struts having a cylindrical housing with a piston rod therein;

said piston rod pivotally attached to said pair of armrests;

said cylindrical housing attached to said bottom side of said pair of side frames.

13. The self-propelling standing commode wheelchair of claim 1, further comprising a chest strap attached to said backrest.

14. The self-propelling standing commode wheelchair of claim 1, further comprising a pair of knee straps;

said pair of knee straps secured around said front edge of said pair of side frames.

15. A self-propelling standing commode wheelchair, comprising:

a wheeled frame having a pair of side frames;

said pair of side frames having a top side, a bottom side, a front edge, a rear edge;

a pair of front wheels attached to said front edge;

a pair of rear wheels attached to said rear edge;

a seat having a front portion and a back portion;

said front portion of said seat pivotally attached to said front edge of said pair of side frames;

a pair of crossing rods connected to said pair of side frames;

wherein said pair of crossing rods is adapted to pivot and collapse when in a collapsed configuration;

a backrest pivotally attached to said back portion of said seat;

wherein said backrest is perpendicular to said seat in a sitting configuration;

wherein said seat is substantially upright in a standing configuration;

a pair of armrests pivotally attached to said backrest;

a pair of gas struts having a cylindrical housing with a piston rod therein;

said piston rod pivotally attached to said pair of armrests;

said cylindrical housing attached to said bottom side of said pair of side frames.

* * * * *